US005466386A

United States Patent [19]

Stewart et al.

[11] Patent Number: 5,466,386

[45] Date of Patent: Nov. 14, 1995

[54] FIRE EXTINGUISHING COMPOSITIONS

[75] Inventors: Harry E. Stewart, Malvern; Donald B. MacElwee, Wayne, both of Pa.

[73] Assignee: POWSUS, Inc., Malvern, Pa.

[21] Appl. No.: 56,956

[22] Filed: May 3, 1993

[51] Int. Cl.[6] ..... A62C 1/00; A62C 1/06

[52] U.S. Cl. ..... 252/2; 252/3; 252/4; 252/7; 252/8

[58] Field of Search ..... 252/2, 3, 4, 8, 252/7

[56] References Cited

U.S. PATENT DOCUMENTS

| | | | |
|---|---|---|---|
| 3,179,588 | 4/1965 | Siimes | 252/2 |
| 3,884,307 | 5/1975 | Williams | 169/59 |
| 3,889,754 | 6/1975 | Dunn | 169/59 |
| 3,963,627 | 6/1976 | Cottrell | 252/4 |
| 4,234,432 | 11/1980 | Tarpley, Jr. | 252/8 |
| 5,053,147 | 10/1991 | Kaylor | 252/7 |
| 5,055,208 | 10/1991 | Stewart et al. | 252/8 |
| 5,219,474 | 6/1993 | Song et al. | 252/8 |

*Primary Examiner*—Philip Tucker
*Assistant Examiner*—Joseph D. Anthony
*Attorney, Agent, or Firm*—Kane, Dalsimer, Sullivan, Kurucz, Levy, Eisele and Richard

[57] ABSTRACT

Fire-extinguishing compositions of low ozone depletion potential comprise dry particles of ammonium bromide coated with an abherent such as zinc stearate to improve flowability. The coated particles enhance the fire-extinguishing properties of chlorofluorocarbons and halogenated paraffins having low ozone depletion properties, when dispersed therein.

9 Claims, No Drawings

FIRE EXTINGUISHING COMPOSITIONS

BACKGROUND OF THE INVENTION

1. Field of the Invention

The invention relates to non-aqueous fire-extinguishing compositions useful in extinguishing Class A, Class B and Class C fires.

2. Brief Description of the Prior Art

The literature is replete with descriptions of fire-extinguishing compositions. Included in such compositions are dry chemicals for smothering flames and inhibiting oxidation (for example sodium and potassium bicarbonate) and vaporizing organic liquids (halogenated hydrocarbons). The latter compounds smother flames very effectively. Their efficiency has led to the extensive use of chlorofluorocarbons as volatile, vaporizing organic liquids in flame suppression. Unfortunately, the chlorofluorocarbons have the potential for destroying ozone in the upper stratosphere, when released into the environment. This impact on the environment has been of great concern.

Recently, some 90 countries participated in a treaty to phase out use of the ozone-destroying chlorofluorocarbons such as those widely used in commercial applications including as fire suppressants. Thus, there is a need for fire-extinguishing compositions which substitute for the chlorofluorocarbons as an effective flame suppressor. However, the substitute must be as effective, if not better than the chlorofluorocarbons previously used in flame suppression.

Ammonium bromide has been suggested as a dry powder component of fire-extinguishing compositions; see U.S. Pat. No. 4,234,432 (Tarpley, Jr.). However the compound has not reached large commercial use because of difficulty in handling due to packing, agglomeration and sintering of the particles.

We have found fire-extinguishing compositions including some containing selected chlorofluoro-carbons of low ozone depletion potential which are highly effective in extinguishing Class B and C fires and some are also useful to extinguish Class A fires as defined by the National Board of Fire Underwriters.

SUMMARY OF THE INVENTION

The invention comprises a non-aqueous, fire-extinguishing composition of low ozone depletion potential, which comprises; a plurality of particles of ammonium bromide coated with a film of a water repelling, solid, non-flammable abherent.

The preferred compositions of the invention are non-corrosive towards metals, including ferrous and aluminum alloys, making them particularly useful in suppressing engine fires such as hydrocarbon fuel fed aircraft engine fires. Thus minimal damage occurs to the engine during flame suppression.

The term "low ozone depletion potential" (ODP) as used herein means a value of less than about 0.5 as determined by the method of Fisher et al., Nature, Vol. 344, pages 508–512 (Apr. 5, 1990).

The term "abherent" as used herein means a solid which will reduce or prevent adhesion between ammonium bromide particle surfaces.

DETAILED DESCRIPTION OF THE PREFERRED EMBODIMENTS OF THE INVENTION

Dry powder fire-extinguishing agents in commercial use are of two principal types. One type is represented by sodium bicarbonate, potassium bicarbonate, ammonium borate, potassium borate, sodium borate (borax), sodium sulfate, sodium phosphate, sodium polyphosphate, sodium chloride, potassium chloride, ammonium bromide and the like.

The second type may be represented by monoammonium phosphate, ammonium polyphosphate and the like.

The fire-extinguishing compositions of the present invention preferably comprise ammonium bromide particles which have been coated with a solid film of a water-repelling, solid, non-flammable abherent to improve particle flowability. The free-flowing compositions of the invention resist particle sticking and agglomeration. The abherents include for example inorganic compounds such as talc, mica, silicic acid, pyrogenic (fumed) silica and the like. Organic abherents are represented by higher fatty acids (having 12 or more carbon atoms) glycerol fatty acid esters and the like. Advantageously the abherent is an organometallic compound such as a metal salt of a higher fatty acid. Representative of such metal salts are zinc stearate, calcium stearate, magnesium stearate, aluminum stearate and the like. Particularly preferred as an abherent is the zinc salt of stearic and palmitic acids or mixtures thereof.

The coated ammonium bromide is advantageously provided in the form of free-flowing, finely divided particles, (crystals or granules), the average particle size being within the range of from about 0.1 to 500 microns, preferably 0.1 to 100 microns, most preferably less than about 50 microns.

The particles of ammonium bromide may be coated, according to the method of the invention, by spray, dusting or brush application. Preferably, the abherent compound is applied in a conventional size reduction mill, for example a fluid energy mill (commonly referred to at times as a jet film process). The coating thickness of dust is not critical, provided it is sufficient to provide abherence between adjacent particles of the ammonium bromide. With particles of the average size described above, the coatings may constitute from about 0.5 to 5.0 percent by weight of the particle composition, preferably from about 1 to 2 percent. The preferred method of application, i.e.; in a fluid energy mill, permits one to dust the ammonium bromide particles with the abherent while simultaneously adjusting the ammonium bromide particles to a desired average size within the range described above. The abherent is thereby firmly dusted unto the particle surfaces of advantageous size.

Fluid energy mills and their operation are well known in the art; see for example the apparatus and method described in U.S. Pat. No. 4,592,302 (Motoyama et al) which is incorporated herein by reference thereto. Using, for example, a jet process type with a centrifugal force particle classifier (such as manufactured by Trust Jet Mill Division of Helme Products, Inc.) the particles of ammonium bromide in admixture with the abherent are pulverized and coated with abherent dust using compressed air as an energy source.

In certain embodiment compositions of the invention, the coated particles of ammonium bromide are uniformly and homogeneously dispersed alone or in admixture with the previously mentioned dry powder fire-extinguishing agents in commercial use, in a volatile fire-extinguishing agent, preferably having a low ozone depletion potential such as bromodichloromethane or dichlorotrifluoroethane. Bromodichloromethane is a vaporizing liquid fire-extinguishing agent, having a vapor pressure of 57 PSIG at 25° C. Most importantly, bromodichloromethane has a low ozone depletion potential (ODP) of 0.19 and dichlorotrifluoroethane has an ODP of about 0.02 (method of Fisher et al., supra.).

The bromodichloromethane and/or the dichlorotrifluoromethane need not be present in the preferred compositions of the invention as the sole liquid carrier for the dry fire-extinguishing powders. Other gelable organic liquid fire-extinguishers (preferably non-polar) may be present and in certain combinations have certain advantages, for example, the volatility of bromodichloromethane is relatively low. Volatile liquids of greater volatility and greater critical vapor pressure such as trifluoromethane and the like when added to the preferred compositions of the invention will increase the overall vapor pressure of the compositions. Volatile liquids of lesser volatility then bromodichloromethane such as methylchloroform, methyliodide, ethyliodide, methylene chloride, dichlorobromopropane, ethylene dibromide, 1,1-dichloro-2,2,2-trifluoroethane and the like, when added to the preferred compositions of the invention will serve to decrease the overall critical vapor pressures. The proportion of volatile liquid in the preferred compositions of the invention may range from about 30 to about 50 percent by weight of the total composition, preferably 40 to 60 percent. In general, at least about 50 percent by weight of the volataile liquid fire extinguisher agent will be bromodicloromethane or dichlorotrifluoroethane.

Other gelable organic liquid fire extinguishers of low ozone depletion potential, which are relatively poor fire extinguishing agents by themselves are advantageously enhanced as extinguishing agents by admixture with the coated ammonium bromide compositions of the invention. For example, the efficiency of 2-chloro-1,1,1,2-tetrafluoroethane as a fire-extinguishing organic liquid is enhanced by admixture with dry powder fire-extinguishing agents, preferably the coated ammonium bromide compositions of the invention. This liquid compound has an ODP of 0.02 and a vapor pressure of 61 PSIA at 25° C. Another advantageous gelable organic liquid fire extinguisher which may be used in the compositions of the invention is 1,1,1,2,3,3,3-heptafluoropropane which has a vapor pressure of 58.8 psia at 25° C. and an ODP of O.

Gelling agents for use in gelling non-aqueous dispersions of dry powdered fire-extinguishing agents in organic liquids are well known and include for example pyrogenic silica (such as the commercially available CAB-O-SIL H5 marketed by G. L Cabot, Inc., Boston, Mass.; pyrogenic alumina (such as Alan C); carboxymethyl cellulose, carogeenin, polycarboxylated vinyl polymers such as carboxypolymethylene and those described in U.S. Pat. No. 4,652,383, incorporated herein by reference thereto, guar gum and the like. A preferred gelling agent is fumed silica/alumina (Coke®-84; DeGussa, Inc. Teterboro, N.J.).

The gelling agents are present in the preferred compositions of the present invention in an amount sufficient to effect gelatin of the liquid ingredients. Gelation is preferably the formation of a thixotrope, having a yield stress of at least about 200 dynes per $cm^2$.

The preferred compositions of the invention may be containerized within containers having the structural strength for withstanding the pressures developed during storage and ambient use temperatures. Generally, these pressures will be within the range of from about 15 to 250 PSIG at room temperatures. Representative of such containers are those described in the U.S. Pat. No. 3,402,665. The container loading is facilitated by cooling the compositions of the invention below their critical vapor pressures, during loading.

The container compositions of the invention may also be overpressured to facilitate discharge, with non-flammable gases such as nitrogen, carbon dioxide, helium, argon and like inert gases, using conventional techniques.

The following examples and preparations describe the manner and process of making and using the invention and set forth the best mode contemplated by the inventors of carrying out the invention but are not to be construed as limiting the invention.

Where reported, the following tests were carried out.

TEST PROCEDURE (UL Standard 711)

A square pan having an area of 2.5 square feet was filled with unleaded gasoline over a bed of water, to within 6" of the upper lip of the pan. The gasoline was ignited and allowed to burn for 60 seconds before attempting to extinguish the flame. Extinguishing the fire in less than 5 seconds earns a 1-B fire rating.

PREPARATION 1

To 454 parts by weight of ammonium bromide granules there was added about 10 parts of zinc stearate with mixing. The mixture was fed to a fluid energy mill to obtain zinc stearate dusted particles of ammonium bromide having average particle size of about 10 to 50 microns.

EXAMPLE 1

A composition is prepared containing 454 gms. of the coated ammonium bromide prepared in Preparation1, supra, dispersed in 464 gms. of 2-chloro-1,1,1,2-tetrafluoroethane ($CF_3$-CHFCL); FE-241, I. E. Dupont de Nemours, Wilmington, Del.; gelled with 1.0 percent by weight of Coke®-84 (fumed silica/alumina, DeGussa). A test fire according to the TestProcedure, supra., was extinguished in 1.87 seconds, to achieve a 1-B rating (UL Standard 711).

EXAMPLE 2

A composition is prepared containing 454 gms. of the coated ammonium bromide prepared according to Preparation1, supra, gelled with 1 percent by weight of Coke®-84, DeGussa, supra. The composition is loaded into an aerosol type container and pressurized with nitrogen gas. When tested according to the TestProcedure, supra, the fire is extinguished in less than 2 seconds, to earn a 1-B rating under UL Standard 711. The composition is sprayed from the container without plugging the nozzle.

EXAMPLE 3

A composition is prepared by suspending 409 gms of mono ammonium phosphate powder in 499 gms of 2-chloro-1,1,1,2-tetrafluoroethane, supra. A test fire according to the TESTINGPROCEDURE, supra., was extinguished in less than 5 seconds, achieving a 1-B rating.

EXAMPLE 4

This example is not an example of the invention, but is made for purposes of comparison.

The procedure of Example3, supra. is repeated, but without adding the mono ammonium phosphate powder to the 2-chloro-1,1,1,2-tetrafluoroethane. The fire extinguishing rating of 1-B is not achieved.

EXAMPLE 5

This example is not an example of the invention, but is made for purposes of comparison.

The procedure of Example2, supra. is repeated except that the coated ammonium bromide is replaced with uncoated ammonium particles of substantially the same particle size. The nozzle is immediately plugged and the fire is not extinguished.

What is claimed is:

1. A non-aqueous fire extinguishing composition, which consist essentially of;

A. a plurality of particles of ammonium bromide, said particles being surface-coated with from 0.5 to 5 percent by weight of the particles of a solid film of a water-repelling, non-inflammable, organometallic abherent, dispersed in B. a volatile organic liquid fire-extinguishing agent gelled with C. a gelling agent selected from the group consisting of fumed silica and fumed alumina.

2. The composition of claim 1 which further comprises from 30 to 50 percent by weight of the volatile organic liquid fire-extinguishing agent.

3. The composition of claim 2 wherein the agent is 2-chloro-1,1,1,2-tetrafluoroethane.

4. A non-aqueous composition useful to extinguish fires, which consist essentially of;

a plurality of particles of, ammonium bromide dispersed in 2-chloro-1,1,1,2-tetrafluoroethane gelled with a gelling agent selected from the group consisting of fumed silica and fumed alumina;

said particles being surface coated with from 0.5 to 5 percent by weight of the particles of a dry film of a solid compound selected from the group consisting of zinc stearate, calcium stearate, magnesium stearate, aluminum stearate and zinc palmitate.

5. The composition of claim 4 wherein the surface coating comprises from 1 to 2 percent by weight of the particles.

6. A non-aqueous solid composition useful to extinguish fires, which consists of;

a plurality of particles of ammonium bromide the surfaces of which are coated with from 0.5 to 5 percent by weight of the particles of a water repelling film, of a solid, non-flammable, organometallic abherent.

7. The composition of claim 6 wherein the particles have average particle diameters of from about 0.1 to 500 microns.

8. The composition of claim 6 wherein the abherent is a metal salt of a fatty acid.

9. The composition of claim 8 wherein the salt is zinc stearate.

* * * * *